US007461500B2

(12) United States Patent
Theis

(10) Patent No.: US 7,461,500 B2
(45) Date of Patent: Dec. 9, 2008

(54) SYSTEM FOR DETERMINING WEAR TO RIGGING SYSTEM LINES

(75) Inventor: Robert J. Theis, Manlius, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 65 days.

(21) Appl. No.: 11/559,672

(22) Filed: Nov. 14, 2006

(65) Prior Publication Data

US 2007/0125060 A1 Jun. 7, 2007

Related U.S. Application Data

(60) Provisional application No. 60/736,589, filed on Nov. 14, 2005.

(51) Int. Cl.
*D02G 3/02* (2006.01)

(52) U.S. Cl. ..... 57/238

(58) Field of Classification Search ..... 57/238, 57/244

See application file for complete search history.

(56) References Cited

U.S. PATENT DOCUMENTS

| | | | | | |
|---|---|---|---|---|---|
| 1,216,964 | A * | 2/1917 | Dodge | 40/316 |
| 1,274,401 | A * | 8/1918 | Everett | 40/316 |
| 1,282,390 | A * | 10/1918 | Dodge | 40/316 |
| 1,635,750 | A * | 7/1927 | Jenks | 40/316 |
| 1,738,316 | A * | 12/1929 | Reber | 40/316 |
| 2,594,610 | A * | 4/1952 | Cripe | 57/210 |
| 3,101,522 | A * | 8/1963 | Hooper et al. | 28/159 |
| 3,681,910 | A * | 8/1972 | Reese | 57/244 |
| 3,968,725 | A * | 7/1976 | Holzhauer | 87/6 |
| 4,155,394 | A * | 5/1979 | Shepherd et al. | 152/527 |
| 4,191,009 | A * | 3/1980 | Thomson | 57/202 |
| 4,229,404 | A * | 10/1980 | Hatcher et al. | 264/290.5 |
| 4,295,329 | A * | 10/1981 | Windley | 57/245 |
| 4,697,407 | A * | 10/1987 | Wasserman | 57/238 |
| 4,819,914 | A * | 4/1989 | Moore | 256/10 |
| 5,605,035 | A * | 2/1997 | Pethrick et al. | 57/200 |
| 5,947,060 | A * | 9/1999 | Weinacker | 119/709 |
| 6,050,077 | A * | 4/2000 | Muller | 57/210 |
| 6,247,359 | B1 * | 6/2001 | De Angelis | 73/158 |
| 6,250,254 | B1 * | 6/2001 | Weinacker | 119/709 |
| 2003/0159768 | A1 * | 8/2003 | Fritsch et al. | 152/556 |
| 2003/0226611 | A1 * | 12/2003 | Moriarty et al. | 139/383 R |

* cited by examiner

*Primary Examiner*—Shaun R Hurley
(74) *Attorney, Agent, or Firm*—George R. McGuire; Bond Schoeneck & King, PLLC

(57) ABSTRACT

A twisted rope for use in rigging systems that includes a differently colored yarn positioned within at least one strand. As the rope is worn, the differently colored yarn will become exposed, thereby serving as a visual indicator of wear to the rope. A plastic strip printed with identifying information about the rope is placed within the fibers of the rope during manufacture may also be positioned with a strand of the twisted rope. A user can simply unravel one end of the rope and read the information printed on the strip to determine, for example, the composition of the rope, when the rope was manufactured, the load-bearing characteristics of the rope, and who was the rope manufacturer.

6 Claims, 2 Drawing Sheets

REPLACEMENT SHEET

SYSTEM FOR DETERMINING WEAR TO RIGGING SYSTEM LINES

PRIORITY CLAIM

The present application claims priority to U.S. Provisional Patent Application Ser. No. 60/736,589, the entirety of which is hereby incorporated by reference.

BACKGROUND OF THE INVENTION

1. Field of Invention

The present invention relates to rigging systems and, more specifically, to a system for determining the wear and characteristics of twisted rope lines used in rigging systems.

2. Description of Prior Art

Most existing rigging systems use manually operated rigging sets (or "sets"), which are counterbalanced with weights for ease of operation. Such sets include various rope lines that are connected via pulleys to the load which needs to be raised or lowered into position. Over repeated use, the lines are subjected to strong frictional forces as they pass along the pulleys and may wear, causing the outermost fibers of rope to fray. Damage such as this can adversely affect the load-bearing characteristics of the lines, and may present serious safety concerns if the damage goes unnoticed. In addition, once lines are purchased and installed in a rigging system, information that is important for determining the load-bearing characteristics and quality of the lines are often lost.

OBJECTS AND ADVANTAGES

It is a principal object and advantage of the present invention to provide a system for identifying when rigging system lines have been subject to wear.

It is an additional object and advantage of the present invention to provide a system for improving the safety of rigging systems.

It is a further object and advantage of the present invention to provide a system for easily identifying characteristics about the lines used in rigging system.

Other objects and advantages of the present invention will in part be obvious, and in part appear hereinafter.

SUMMARY OF THE INVENTION

In accordance with the foregoing objects and advantages, the present invention comprises the addition of differently colored fibers to a rigging line. As the rigging line is subject to wear, a user can easily identify when the damage has progressed beyond a predetermined point simply by checking the lines to see whether the colored fibers are visible. In another embodiment of the present invention, a plastic strip that has been printed with identifying information about the line is placed within a strand of the line during manufacture. As a result, a user can simply unravel and end of the line and read the information printed on the strip to determine, for example, the composition of the line, when the line was manufactured, and who was the manufacturer.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
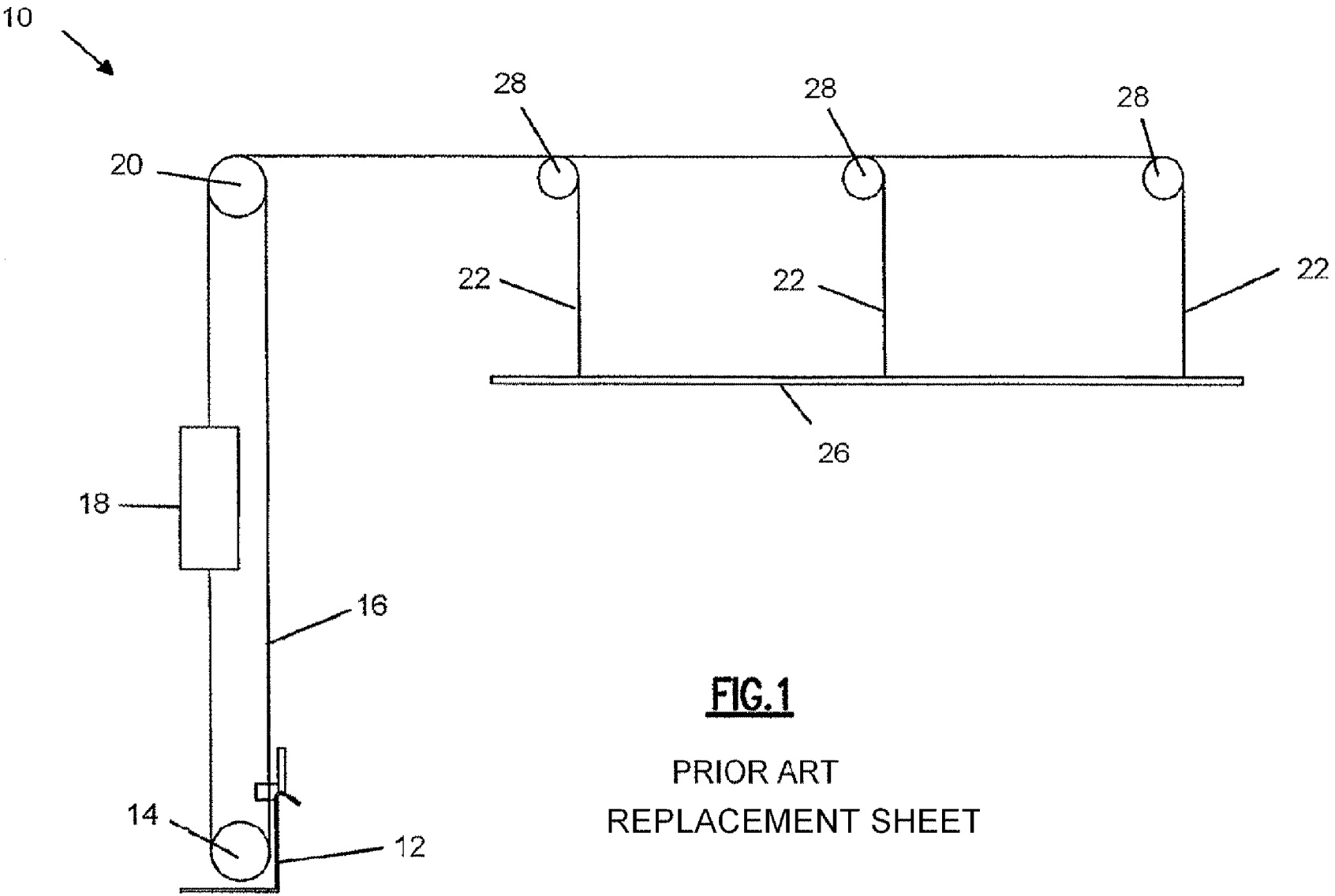
FIG. 1 PRIOR ART
FIG. 1 is a schematic of a conventional rigging system.

Referring now to the drawings, wherein like numbers refer to like parts throughout, there is seen in FIG. 1, a conventional rigging set 10. Rigging set 10 comprises a locking rail 12 fixed to the floor, a tensioning floor block 14 around which a control line 16 passes, a counterweight arbor 18 the opposing sides to which opposite ends of the control line 16 attach, a head block 20 around which control line 16 passes and which gather lift lines 22 that otherwise extend between arbor 18 and a batten 26 to which the load is attached. Any number of pulleys 28 may be positioned at appropriate locations above batten 26 to accept and guide lift lines 22. Control line and lift lines 22 generally constitute appropriate lengths of natural or synthetic twisted rope having load-bearing characteristics which meet or exceed industry standards or job requirements.

Figures 2, 3:
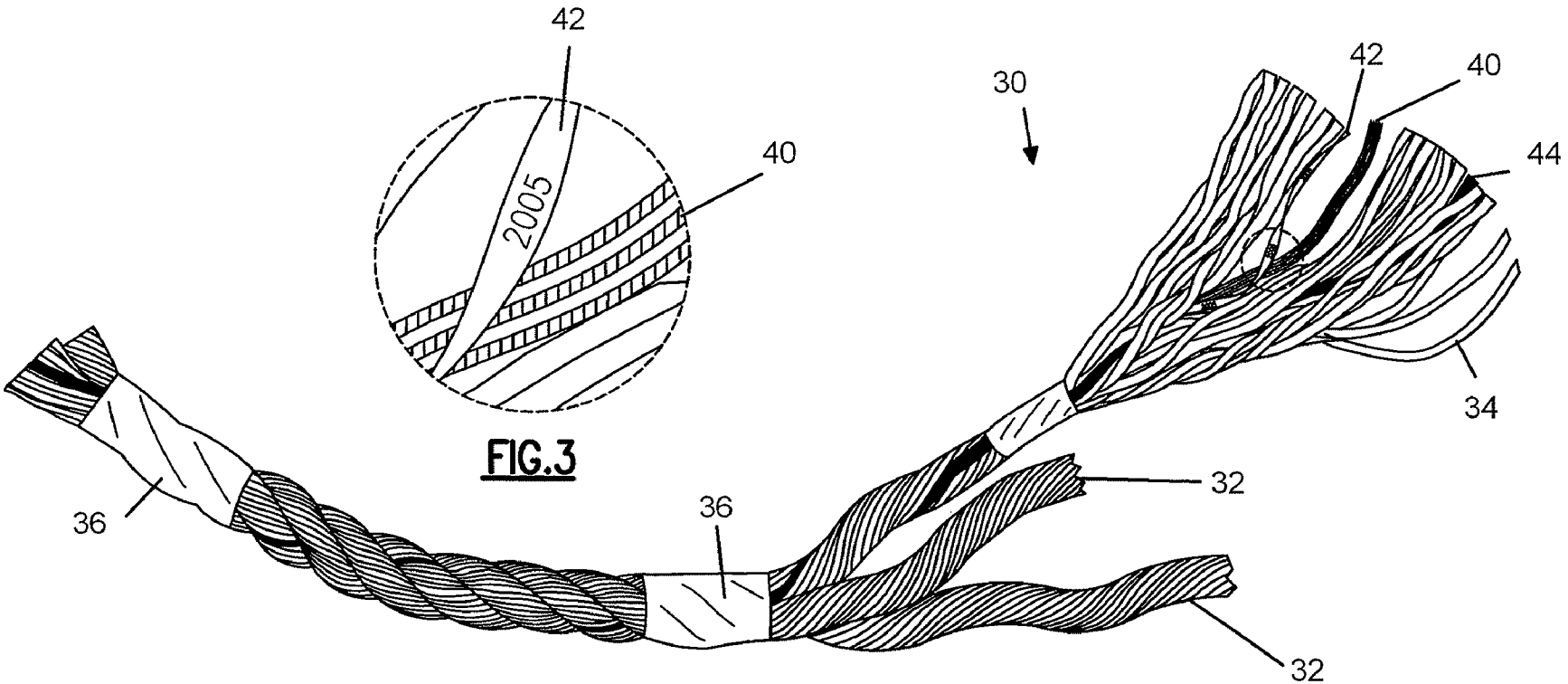
FIG. 2 is a perspective view of a segment of a twisted rope formed according to the present invention.
FIG. 3 is a close-up view of a segment of a twisted rope formed according to the present invention.

As seen in FIG. 2, twisted rope 30 is comprised of three strands 32 that have been twisted and bound together at appropriate intervals. Twisted rope 30 is typically formed from a plurality of fibers that are gathered and spun to form a yarn 34. A number of yarns 34 are then twisted together to form strand 32. Three strands 32 are then twisted together to form rope 30, which is bound at its ends or at predetermined points along its length by some means, such as tape 36, to prevent untwisting.

One embodiment of the present invention involves the addition of one or more differently colored yarns 40 into at least one of strands 32 of twisted rope 30. Differently colored yarns 40 are preferably positioned sufficiently within the conventional yarns 34 of strand 32 so that differently colored yarn 40 is not immediately visible to the naked eye. As lines 16 and 22 become worn through normal use in rigging system 10, such as by the frictional forces of floor block 14, head block 20, and pulleys 28, fraying of the outermost yarns 34 of twisted rope 30 will eventually expose differently colored yarns 40, thereby providing a visual indicator of wear to twisted rope 30. The acceptable degree of wear to twisted rope 30 may be correspondingly reflected in how close to the center of strand 32 differently colored yarns 40 are positioned. For example, in an application where only a slight degree of wear to twisted rope 30 is acceptable, differently colored yarns 40 should be positioned as close as possible to the outer surface of strand so that they are more easily exposed by wear and tear on twisted rope 30.

Another embodiment of the present invention involves the addition of an identifying strip 42 into at least one strand 32 of twisted rope 30. Identifying strip 42 may preferably be made of a synthetic material, such as plastic, and printed with information about the characteristics, nature, or manufacture of twisted rope 30. For example, identifying strip 42 may be printed with name of the manufacturer, the synthetic (or natural) composition of twisted rope 30, the date when rope 30 was first formed, e.g., "2005" in FIG. 3, load-bearing information, or any other such information which may be beneficial to a user of twisted rope 30. For ease of locating such information, identifying strip 42 may be included in the same strand 32 as a differently colored indicating yarn 44.

What is claimed is:

1. A first strand of rope comprised of a plurality of strands and for use in a rigging system, wherein the first strand includes an exterior that is visually perceptible, an interior hidden from view when the first strand of rope is in perfectly operable condition but becomes visually perceptible as the first strand of rope becomes worn, and a longitudinally extending center-line, the first strand of rope comprising:

a. a plurality of first yarn of a first color twisted together to form the first strand of rope; and b. at least one second yarn of a second color visually distinct form said first color and twisted together with at least one of said plurality of first yarns, wherein said at least one second yarn is sufficiently positioned in said interior of said first strand of rope so as to be hidden from view when the first strand of rope is in perfectly operable condition.

2. The first strand of rope according to claim 1, further comprising at least one third yarn twisted together with at least one of said plurality of first yarns, said at least one third yarn including indicia imprinted thereon representative of physical attributes of the first strand of rope.

3. The first strand of rope according to claim 2, wherein said indicia comprises data representative of the manufacturer of the first strand of rope.

4. The first strand of rope according to claim 2, wherein said indicia comprises data representative of the date the strand of rope was manufactured.

5. The first strand of rope according to claim 2, wherein said indicia comprises data representative of the load bearing capacity of the first strand.

6. The first strand of rope according to claim 1, further comprising at least one third yarn of a third color visually distinct from said first and second colors and twisted together with at least one of said plurality of first yarns, wherein each of said at least one third yarns is positioned closer to the longitudinal center-line than each of said at least one second yarns.

* * * * *